US008043178B2

(12) United States Patent
Sames

(10) Patent No.: US 8,043,178 B2
(45) Date of Patent: Oct. 25, 2011

(54) BROADHEAD FOR BOW HUNTING ARROW

(76) Inventor: Gregory A. Sames, Tobaccoville, NC (US)

( * ) Notice: Subject to any disclaimer, the term of this patent is extended or adjusted under 35 U.S.C. 154(b) by 385 days.

(21) Appl. No.: 12/314,383

(22) Filed: Dec. 9, 2008

(65) Prior Publication Data

US 2009/0170644 A1 Jul. 2, 2009

Related U.S. Application Data

(60) Provisional application No. 61/006,178, filed on Dec. 28, 2007.

(51) Int. Cl.
*F42B 6/08* (2006.01)

(52) U.S. Cl. ..... 473/583

(58) Field of Classification Search ..... 473/583, 473/584

See application file for complete search history.

(56) References Cited

U.S. PATENT DOCUMENTS

| | | | | |
|---|---|---|---|---|
| 2,888,264 | A | 5/1959 | Sharrer et al. | |
| 5,044,640 | A | 9/1991 | DelMonte et al. | |
| 5,064,202 | A * | 11/1991 | Barner | 473/583 |
| 5,494,298 | A * | 2/1996 | Maleski | 473/584 |
| 6,077,180 | A * | 6/2000 | Adams, Jr. | 473/584 |
| 6,863,630 | B1 | 3/2005 | Watkins et al. | |

* cited by examiner

*Primary Examiner* — John Ricci
(74) *Attorney, Agent, or Firm* — Richard C. Litman

(57) ABSTRACT

The broadhead for bow hunting arrow is an arrowhead having: a ferrule; a plurality of planar, generally triangular blades extending radially from the ferrule; a fitting for attaching the arrowhead to an arrow shaft; a pointed tip; and a ring or annular blade mounted to the outermost edges of the triangular blades. In one embodiment, the triangular blades have notches defined therein, and the ring has slits corresponding to the triangular blades extending into the body of the ring that the upper legs of the notches engage to prevent rotation of the ring. In another embodiment, the triangular blades have slots and the ring has slits extending into the ring with the slots engaging the slits to prevent rotation of the ring. Alternatively, the ring may be fixed to the triangular blades by welding or by any other means. The broadhead is particularly well suited for hunting large game animals.

10 Claims, 7 Drawing Sheets

BROADHEAD FOR BOW HUNTING ARROW

CROSS-REFERENCE TO RELATED APPLICATION

This application claims the benefit of U.S. Provisional Patent Application Ser. No. 61/006,178, filed Dec. 28, 2007.

BACKGROUND OF THE INVENTION

1. Field of the Invention

The present invention relates to arrowheads for archery, and more particularly to a broadhead for a bow hunting arrow having a cutting ring that promotes bleeding.

2. Description of the Related Art

Archery is the common art of using a bow to shoot arrows. Historically, a bow and arrow combination was used for warfare and hunting, until the advance of firearms. Today, archery has evolved into a precision sport that is commonly engaged in by hunters of wild game.

Frequently, when a large game animal, such as a deer or elk, is struck by an arrow, the animal will run away, even when mortally wounded. The hunter must often track his game. The arrowhead may penetrate deeply, and the wound may close around the shaft, so that sometimes there is no significant trail of blood, or the trail of blood may be too short to aid the hunter in the task of tracking the animal. If the wound is not mortal, the animal is often forced to endure prolonged agony.

Consequently, there is a need for a hunting arrowhead that will open a large wound to ensure a copious trail of blood, and that will be likely to inflict a fatal wound. Thus, a broadhead for a bow hunting arrow solving the aforementioned problems is desired.

SUMMARY OF THE INVENTION

The broadhead for bow hunting arrow is an arrowhead having: a ferrule; a plurality of planar, generally triangular blades extending radially from the ferrule; a fitting for attaching the arrowhead to an arrow shaft; a pointed tip; and a ring or annular blade mounted to the outermost edges of the triangular blades. In one embodiment, the triangular blades have notches defined therein, and the ring has slits corresponding to the triangular blades extending into the body of the ring that the upper legs of the notches engage to prevent rotation of the ring. In another embodiment, the triangular blades have slots defined therein, and the ring has slits corresponding to the triangular blades extending into the body of the ring with the slots and the slits engaging to form a locking mechanism to prevent rotation of the ring. Alternatively, the ring may be fixed to the triangular blades by welding or by any other means. The broadhead is particularly well suited for hunting large game animals.

The tip of the arrowhead may be a cap similar to a field point tip that can be attached to the end of the ferrule by pressure fit, by adhesive, by a threaded fitting, or in any other suitable manner, or the tip may be formed by the blades themselves. The fitting for attaching the arrowhead to the shaft may be a threaded stub that engages a threaded socket in the end of the shaft, or a male of female fitting that forms a pressure fit with a corresponding fitting at the end of the shaft, a socket or ring secured to the shaft by glue, etc.

Both the triangular blades and the ring may have razor-sharp edges facing the tip end of the arrowhead. The combination of the triangular blades sloping inward towards the pointed tip end of the arrowhead for initial penetration of the target, with the annular blade following, forms a larger diameter wound to ensure a bloody trail for the hunter to track, and fixing the ring to the triangular blades provides stability and a flatter trajectory for the arrow.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
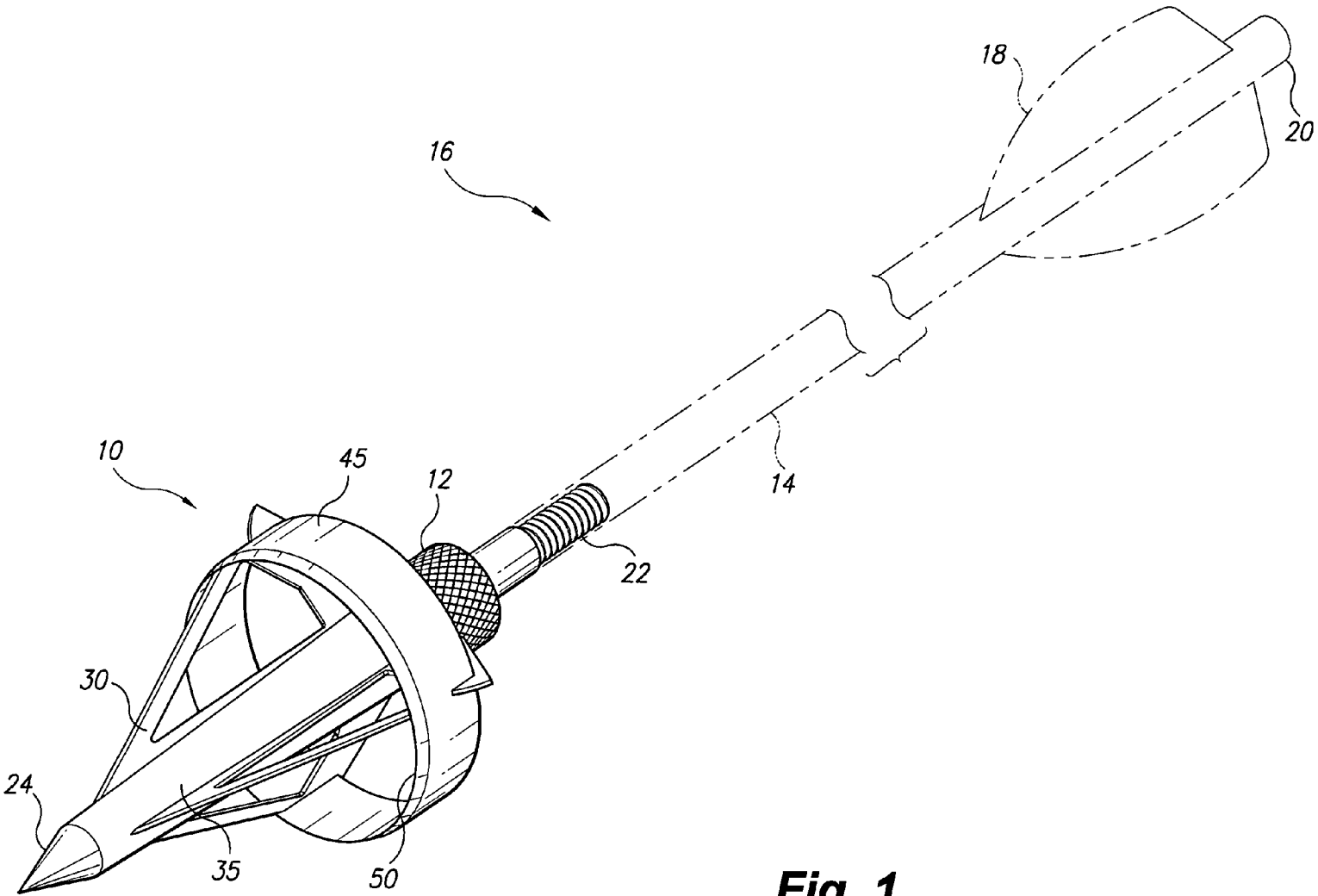
FIG. 1 is an environmental, perspective view of a first embodiment of a broadhead for a bow hunting arrow according to the present invention.

The present invention relates to a broadhead for a bow hunting arrow. FIGS. 1-3 show a first embodiment of a broadhead according to the present invention, designated generally as 10 in the drawings. The broadhead 10 has an elongated, cylindrical ferrule 35 having a fitting 12 extending from one end adapted for attaching the broadhead 10 to the shaft 14 of an arrow 16 having conventional fletching 18 and a nock 20 for use with a bow. In the drawings, fitting 12 is shown to include a threaded stub 22 adapted for engaging a threaded socket at the end of shaft 14, the threaded stub 22 being coaxial with ferrule 35. Threaded stub 22 permits shaft 14 to be used with a field point tip arrowhead for target practice or the like, which can then be removed and replaced by broadhead 10 for hunting. However, it will be understood that fitting 12 may be any fitting adapted for attachment to the shaft of a hunting arrow, e.g., male or female press fit components, a socket that may be glued to shaft 14, etc.

A pointed tip 24 is formed at the opposite end of ferrule 35. A plurality of substantially flat, planar, generally triangular blades 30 extend radially from the ferrule 35. Although shown as having at least three legs defining a polygon having an open interior region 32, the blades may be solid, if desired. Each blade 30 has a sloping cutting edge 34 that joins the ferrule 35 adjacent the pointed tip end 24, and slopes outward from the ferrule 35 as the cutting edge extends rearward towards the fitting 12. The cutting edge 34 is honed to razor sharpness to penetrate the thick hide of a game animal.

Although shown as having three blades 30, the broadhead 10 may have as few as two blades or as many as four blades. The blades 30 are equiangularly spaced, preferably being three blades spaced apart by 120°. The pointed tip 24 may be a cap similar to a field point tip that can be attached to the end of the ferrule by pressure fit, by adhesive, by a threaded fitting, or in any other suitable manner. Alternatively, the pointed tip 24 may be formed by a junction of the vertices of the blades 30 themselves.

The broadhead 10 also includes a ring 45 or annular blade mounted on blades 30. The ring 45 has a cutting edge 50 honed to razor sharpness facing the pointed tip 24 of the broadhead 10. The ring 45 cuts a larger diameter wound when the broadhead 10 penetrates the hide of the game animal, ensuring a more copious flow of blood to leave a track for the hunter to follow, as well as making it more likely that the wound will prove fatal. The ring 45 also provides the broadhead with greater stability in flight and a flatter trajectory.

Figure 2A:
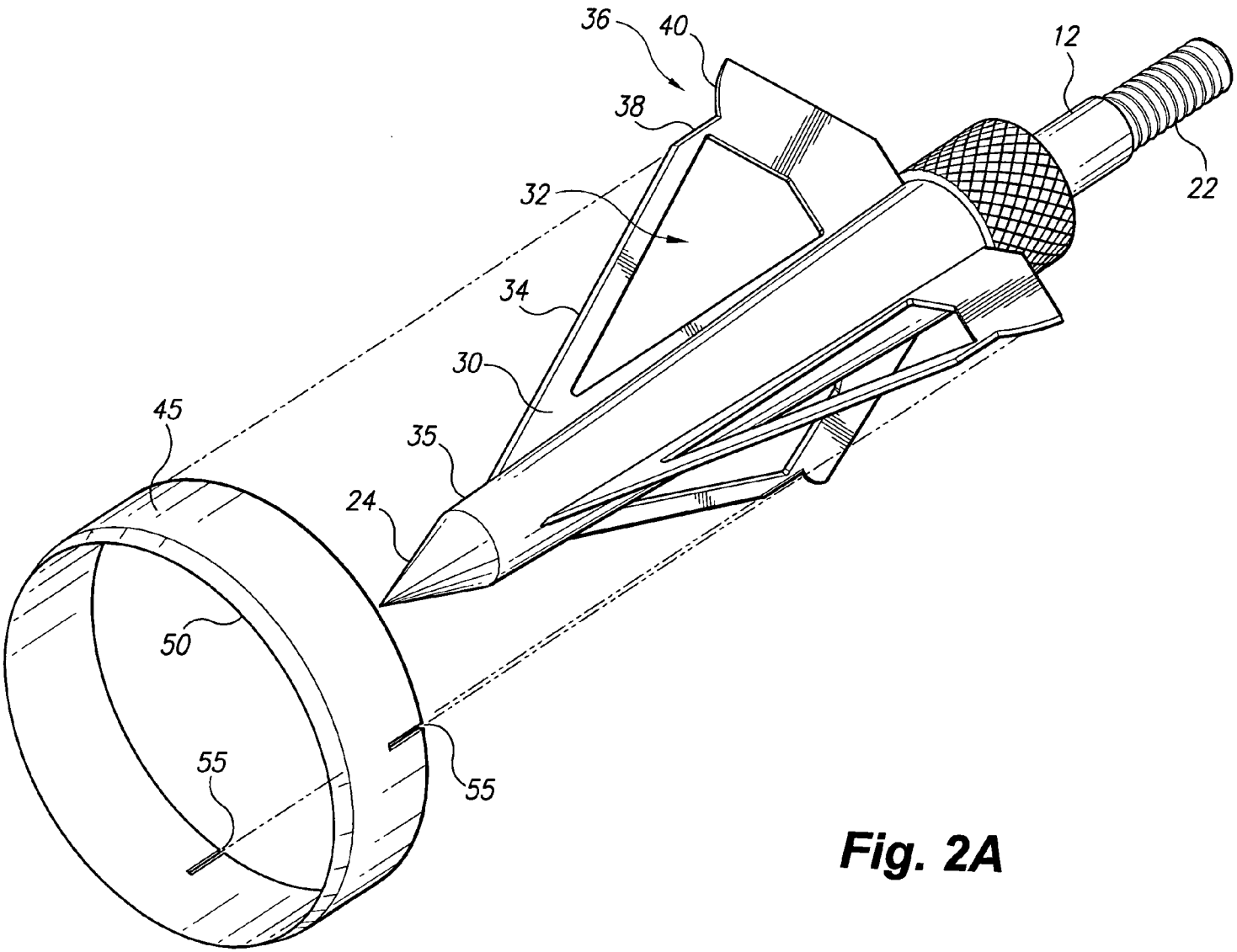
FIG. 2A is a partially exploded perspective view of the broadhead for a bow hunting arrow of FIG. 1.
Figure 2B:
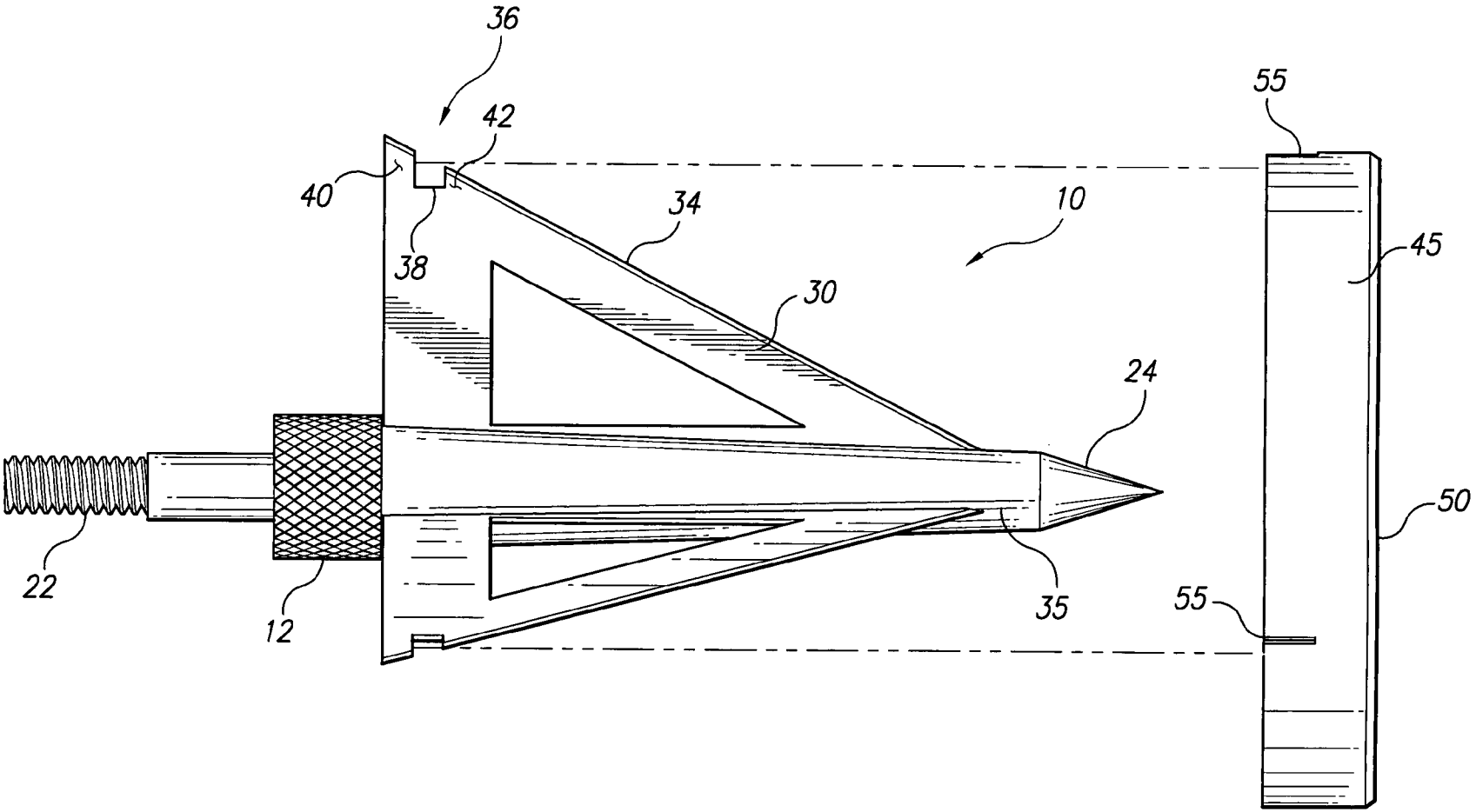
FIG. 2B is a partially exploded perspective view of a broadhead for a bow hunting arrow according to the present invention having a different configuration of blades than the broadhead of FIGS. 1 and 2A.
Figure 3:
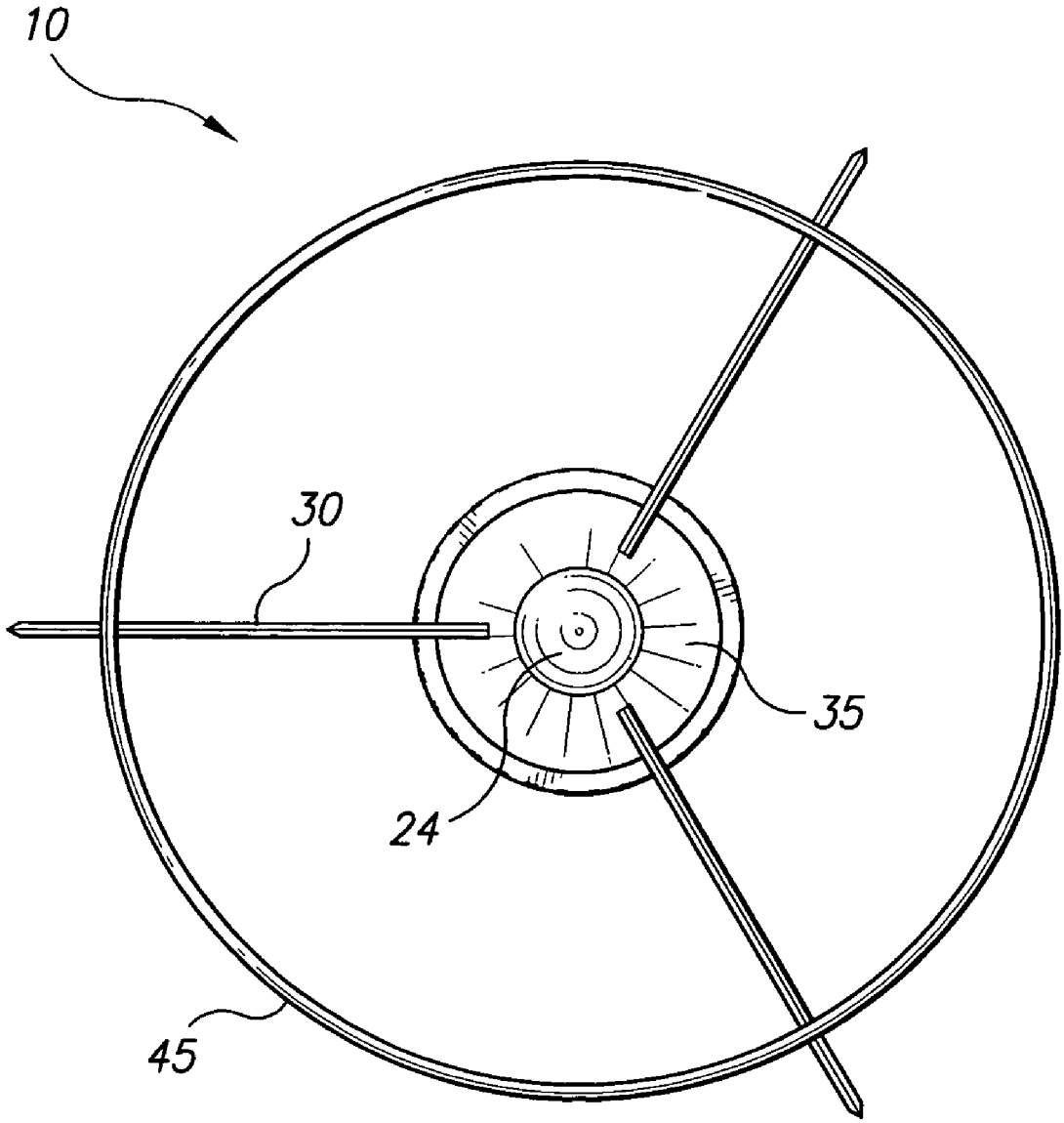
FIG. 3 is an end view the broadhead for a bow hunting arrow of FIG. 1.

As shown more clearly in FIG. 2A, the ring 45 has slits 55 extending through the edge opposite cutting edge 50 that correspond to the number of blades 30. Each of the blades 30 has a notch 36 defined therein that extends into the cutting edge 34. The notch 36 defines at least a side leg 38 substantially parallel to the ferrule 35 and a top leg 40 generally normal to the ferrule 35, although top leg 40 may be arcuate or may have a slight upward slope. The ring 45 forms a press fit with the blade notches 36, with the top legs 40 extending into the slits 55 to preclude rotation of the ring 45 and to help retain the ring 45 in the notches 36. If desired, each of the notches 36 may also have a bottom leg 42, as shown in FIG. 2B, to further preclude the ring 45 from slipping off the pointed tip end 24 of the broadhead 10 when the broadhead 10 is removed from the wound.

Figure 4:
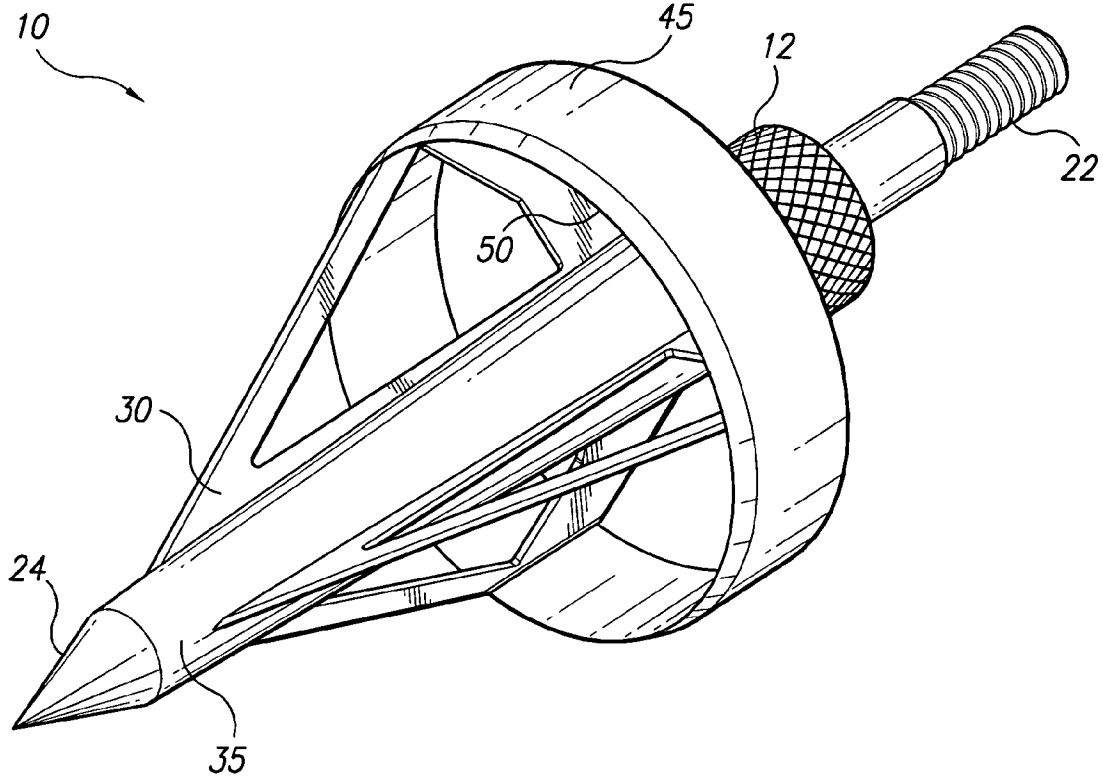
FIG. 4 is a perspective view of a second embodiment of a broadhead for a bow hunting arrow according to the present invention.
Figure 5:
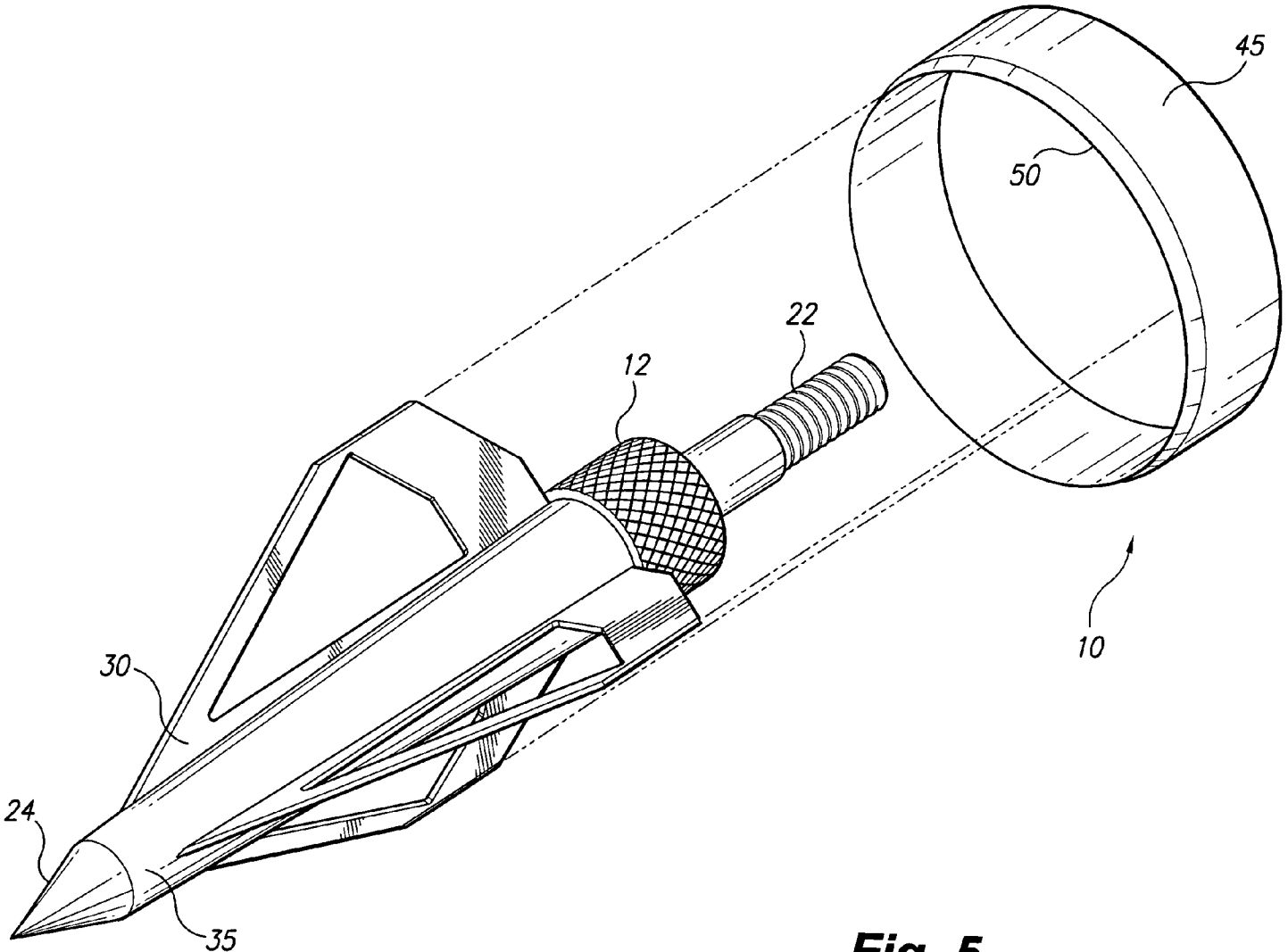
FIG. 5 is a partially exploded perspective view of the broadhead for a bow hunting arrow of FIG. 4.

Alternatively, as shown in FIGS. 4 and 5, the ring 45 need not have slits 55, but may be affixed to the blades 30 by welding or soldering the ring 45 to the blades 30.

Ring 45 is shown made of steel (preferably surgical steel), having a thickness of about 1,600 mm to about 2,200 mm and a width of about ¼ in to about ½ in. The ring 45 could, however, be made of other metals or rigid material capable of defining a cutting edge in the ring's periphery.

Figure 6:
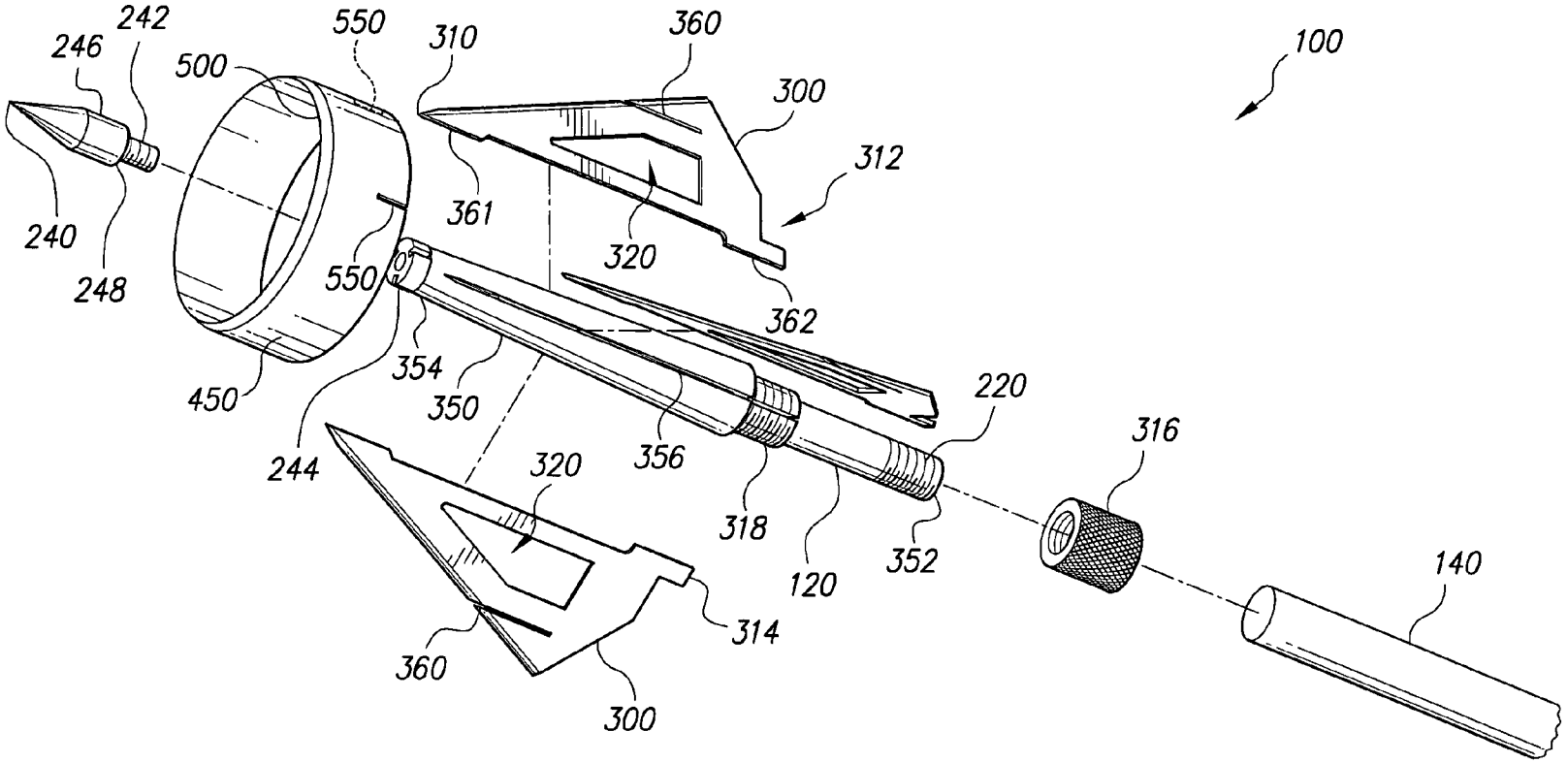
FIG. 6 is an exploded perspective view of a third embodiment of a broadhead for a bow hunting arrow according to the present invention.

A third embodiment of the present invention is shown in FIG. 6, with a broadhead, designated generally with the number 100. The broadhead 100 has an elongated, cylindrical ferrule 350 having a fitting 120 extending from a rear end 352 of the ferrule 350 adapted for attaching the rear end 352 of the broadhead 100 to a shaft 140 of an arrow for use with a bow, not shown. The fitting 120 is shown to include a threaded stub 220 adapted for engaging a threaded socket at the end of shaft 140, the threaded stub 220 being coaxial with the ferrule 350. Threaded stub 220 permits shaft 140 to be used with a field point tip arrowhead for target practice or the like, which can then be removed and replaced by broadhead 100 for hunting. However, it will be understood that fitting 120 may be any fitting adapted for attachment to the shaft of a hunting arrow, e.g., male or female press fit components, a socket that may be glued to shaft 140, etc.

A detachable pointed tip 240 is attached at a forward end 354 of the ferrule 350. The threaded stub 242 engages a threaded socket 244 at the forward end 354 of the ferrule 350. The threaded stub 242 being coaxial with the ferrule 350.

A plurality of substantially flat, planar, generally triangular blades 300 attach radially to the ferrule 350. The ferrule 350 has a groove or slot 356 cut from the front end 354 to nearly the rear end 352 for receiving each of the blades 300. Once the blades 300 are slid into the respective slot 356, a tip 310 each of the blades 300 mates with the angular cutout 248 of the body portion 246 of the pointed tip 240 causing a secure and tight fit. At a rear end 312 of each of the blades 300 is a notch 314. The rear end notch 314 of each of the blades 300 are secured by a lock nut 316 that is screwed on to the rear end 352 of the ferrule 350 and mates with threaded section 318. The lock nut 316, when tightened, forces the tip 310 of each of the blades 300 into the angular cutout 248 of the body portion 246. Additionally, each blade 300 has two extending tabs 361, 362 that will extend into the groove 356 of the ferrule 350 and into the treaded section 318 positioning the notch 314 so the locking nut 316 can be tightened over the notch 314. Thus, the blades 300 are secured in an upright position with a sloping cutting edge 340 of the blades 300 facing forward or toward the pointed tip 240 of the broadhead 100.

Although shown as having at least three legs defining a polygon or triangle having an open interior region 320, the blades 300 may be solid, if desired. The blades 300 slope outward from the ferrule 350 as the cutting edge 340 extends rearward towards the fitting 120. The cutting edge 340 is honed to razor sharpness to penetrate the thick hide of a game animal.

Although shown as having three blades 300, the broadhead 100 may have as few as two blades or as many as four blades. The blades 300 are equiangular spaced, preferably being three blades spaced apart by 120°. The pointed tip 240 may be a cap similar to a field point tip that can be attached to the forward end 354 of the ferrule with the threaded fitting 242, or in any other suitable manner.

The broadhead 10 also includes a ring 450 or annular blade mounted on blades 300. The ring 450 has a cutting edge 500 honed to razor sharpness facing the pointed tip 240 of the broadhead 100. The ring 450 is slightly wider than that of ring 45 in FIGS. 1-5. The ring 450 cuts a larger diameter wound when the broadhead 100 penetrates the hide of the game animal, ensuring a more copious flow of blood to leave a track for the hunter to follow, as well as making it more likely that the wound will prove fatal. The ring 450 also provides the broadhead with greater stability in flight and a flatter trajectory. Thus, the ring or annular blade 450 is more aerodynamic because the width provides stability and a straighter flight for the arrow.

The ring 450 has slits 550 extending through the edge opposite cutting edge 500 that correspond to the number of blades 300. Each of the blades 300 has a slot or groove 360 defined therein. The slots 360 extend into the sloping cutting edges 340 of each of the blades 300 and are substantially parallel to the ferrule 350. The slots 360 in the sloping edges 340 mate with the slits 550 of the ring 450 and form a locking mechanism that precludes the ring 450 from slipping off the pointed tip end 240 of the broadhead 100 when the broadhead 100 is removed from the wound. The locking mechanism further insures that the ring 450 is secured to the blades 300 so they move in tandem with the broadhead 100 during flight.

It is to be understood that the present invention is not limited to the embodiments described above, but encompasses any and all embodiments within the scope of the following claims.

I claim:

1. A broadhead for a bow hunting arrow, comprising:

an elongated ferrule having a first end and a second end;

a plurality of planar, generally triangular blades extending radially from the ferrule;

a fitting for attaching the arrowhead to an arrow shaft extending from the first end of the ferrule;

a pointed tip formed at the second end of the ferrule, each of the triangular blades having a cutting edge facing the pointed tip, each of the cutting edges having a notch formed therein adjacent the first end of the ferrule, the notches having a side leg parallel to the ferrule and a top leg extending generally normal to the ferrule; and a ring mounted to the cutting edges of the triangular blades, the ring having a cutting edge facing the pointed tip and defining an annular blade, the ring having a plurality of slits defined therein corresponding to the triangular blades, the upper leg of the blade having notches extending into the corresponding slits to prevent rotation of the ring.

2. The broadhead for a bow hunting arrow according to claim 1, wherein the pointed tip further comprises a body portion having a threaded fitting removably attaching the pointed tip to the second end of the ferrule.

3. The broadhead for a bow hunting arrow according to claim 1, wherein the ferrule has a plurality of grooves extending substantially from the first end to the second end, the plurality of grooves receiving each of the plurality of triangular blades, the ferrule further comprising a locking nut received by the first end of the ferrule, the locking nut securing each of the triangular blades on the ferrule in an upright position.

4. The broadhead for a bow hunting arrow according to claim 1, wherein the triangular blades and the annular blade each have razor-sharp edges facing the pointed tip for initial penetration of a target, the annular blade forming a large diameter wound to prevent coagulation of blood after penetration of the target.

5. The broadhead for a bow hunting arrow according to claim 1, wherein the notches of the triangular blades and the plurality of slits of the ring form a locking mechanism providing stability and a flatter trajectory for the arrow.

6. A hunting arrow, comprising:

an elongated shaft having a first end and a second end;

a nock defined in the first end;

fletching extending radially from the shaft adjacent the first end; and a broadhead attached to the second end of the shaft, the broadhead having:

an elongated ferrule having a first end and a second end;

a plurality of planar, generally triangular blades extending radially from the ferrule;

a fitting for attaching the arrowhead to the second end of the shaft, the fitting extending from the first end of the ferrule;

a pointed tip formed at the second end of the ferrule, each of the triangular blades having a cutting edge facing the pointed tip, each of the cutting edges having a slot formed therein parallel to the ferrule; and a ring mounted to the cutting edges of the triangular blades, the ring having a cutting edge facing the pointed tip and defining an annular blade, the ring having a plurality of slits defined therein corresponding to the slots of each of the triangular blades, the slots extending into the corresponding slits to prevent rotation of the ring.

7. The broadhead for a bow hunting arrow according to claim 6, wherein the pointed tip has a body portion having a threaded fitting removably attaching the pointed tip to the second end of the ferrule.

8. The broadhead for a bow hunting arrow according to claim 6, wherein the ferrule has a plurality of grooves extending substantially from the first end to the second end, the plurality of grooves receiving each of the plurality of triangular blades, the ferrule further comprising a locking nut received by the first end of the ferrule, the locking nut securing each of the triangular blades on the ferrule in an upright position.

9. The broadhead for a bow hunting arrow according to claim 6, wherein the triangular blades and the annular blade have razor-sharp edges facing the pointed tip for initial penetration of a target, the annular blade forming a large diameter wound to prevent coagulation of blood after penetration of the target.

10. The broadhead for a bow hunting arrow according to claim 6, wherein the notches of the triangular blades and the plurality of slits of the ring form a locking mechanism providing stability and a flatter trajectory for the arrow.

* * * * *